US005228954A

United States Patent [19]

Vinson et al.

[11] Patent Number: 5,228,954

[45] Date of Patent: Jul. 20, 1993

[54] CELLULOSE PULPS OF SELECTED MORPHOLOGY FOR IMPROVED PAPER STRENGTH POTENTIAL

[75] Inventors: Kenneth D. Vinson, Germantown; John P. Erspamer, Bartlett, both of Tenn.

[73] Assignee: The Procter & Gamble Cellulose Company, Cincinnati, Ohio

[21] Appl. No.: 705,845

[22] Filed: May 28, 1991

[51] Int. Cl.[5] ..... D21H 11/00

[52] U.S. Cl. ..... 162/100; 162/55; 162/147; 162/149

[58] Field of Search ..... 162/100, 147, 149, 91, 162/55

[56] References Cited

U.S. PATENT DOCUMENTS

| | | | |
|---|---|---|---|
| 1,951,017 | 3/1934 | Hatch | 92/20 |
| 3,041,246 | 6/1962 | Bolaski et al. | 195/8 |
| 3,085,927 | 4/1963 | Pesch | 162/55 |
| 3,301,745 | 1/1967 | Coppick et al. | 162/55 |
| 3,352,745 | 11/1967 | Malm | 162/55 |
| 3,406,089 | 10/1968 | Yerkes, Jr. | 162/199 |
| 3,441,130 | 4/1969 | Sisson et al. | 209/2 |
| 3,791,917 | 2/1974 | Bolton, III | 162/55 |
| 4,292,122 | 9/1981 | Karnis et al. | 162/28 |
| 4,562,969 | 1/1986 | Lindahl | 241/21 |
| 4,731,160 | 3/1988 | Prough et al. | 162/55 |
| 4,776,926 | 10/1988 | Lindahl | 162/28 |
| 4,888,092 | 12/1989 | Prusas et al. | 162/130 |
| 4,915,821 | 4/1990 | Lamort | 209/17 |
| 4,923,565 | 5/1990 | Fuentes et al. | 162/72 |
| 4,938,843 | 7/1990 | Lindhal | 162/55 |

OTHER PUBLICATIONS

J. P. Casey "Pulp and Paper; Chemistry & Chemical Technology," 3rd Ed., vol. II, Chapter 7 pp. 939–940, John Wiley & Sons, New York 1980.

*Primary Examiner*—Peter Chin

*Attorney, Agent, or Firm*—Bart S. Hersko; Gerry S. Gressel; Larry L. Huston

[57] ABSTRACT

Cellulose pulp compositions of selected fiber morphology are disclosed. Of particular interest, are morphological forms of wood fibers with the potential to achieve improved paper strength without suffering the penalty of slow drainage rate. These cellulose pulps are especially useful for efficiently producing paper structures such as tissue paper of requisite strength.

22 Claims, 8 Drawing Sheets

CELLULOSE PULPS OF SELECTED MORPHOLOGY FOR IMPROVED PAPER STRENGTH POTENTIAL

TECHNICAL FIELD

This invention relates, in general, to cellulose pulps; and more specifically to cellulose pulps of various levels of fibrillation and other selected enhanced physical forms and shapes.

BACKGROUND OF THE INVENTION

Cellulose pulps which contain fibers that offer improved strength to paper webs are in increasing demand. Fibers which offer improved strength give the papermaker the option of reducing weight or including fibrous or non-fibrous filler material to reduce cost and/or amplify other properties of paper such as optical or tactile qualities. Further, as the world's supply of native fiber becomes increasingly scarce and more expensive, it has become necessary to consider lower cost, more abundant sources of cellulose to make paper products. This has caused a broader interest in papermaking with traditionally lower quality sources of fiber such as high lignin-content fibers and hardwood fibers, as well as fibers from recycled paper. Unfortunately, these sources of fiber often result in the comparatively severe deterioration of the strength characteristics of paper compared to conventional virgin chemical pulp furnishes.

Because of the above-mentioned reasons, methods of increasing the strength potential of fibrous pulps are currently of great interest. One well known method of increasing the tensile strength of paper made from cellulose pulp is to mechanically refine the pulp prior to papermaking. However, while additional refining increases the tensile strength, it invariably reduces the rate at which water will drain through a mat of the cellulose fiber composition. Such impaired drainage can reduce the efficiency of high speed papermachines by retarding the bulk removal of water and subsequent drying of the traveling paper web.

Another method for increasing the paper strength potential is to add chemical strength additives (e.g. resins, latexes, binders, etc.) to the pulp furnish to augment the natural bonding which takes place between cellulose fibers during the papermaking operation. While such strength additives are comparatively successful, they can add significantly to the cost of raw materials to make the paper and are often accompanied by a reduction in the efficiency of the papermaking operation as well.

It is also taught in the art to fractionate cellulose fibers to obtain the fractions most suited to making certain types of papers. See, for example, U.S. Pat. No. 3,085,927, Pesch, issued Apr. 16, 1963, incorporated herein by reference. Pesch teaches the centrifugal separation of heterogeneous mixtures of springwood and summerwood fibers into fractions predominantly composed of each singular type of fiber. Additionally, Pesch's centrifugal separation, which distinguishes between fibers having different apparent specific gravity, can yield a springwood pulp having higher tensile strength. While such a procedure is somewhat effective at increasing the tensile strength, the tensile strength at a given level of drainage resistance is not greatly improved.

Other exemplary art includes U.S. Pat. No. 3,791,917, Bolton, issued Feb. 12, 1974. Bolton teaches that layered kraft paper with improved properties can be made by classifying fibers by length and relegating each length classification to its own layer in the structure. Methods of classifying which separate fibers by their length are effective at yielding a high strength fraction, i.e., the long fiber fraction. However, long fibers cause difficulties in papermaking because of their greater tendency to entangle, resulting in the production of flocks which detract from the appearance of the paper and degrade properties which are sensitive to uniformity.

Accordingly, it would be desirable to provide a cellulose pulp that offers a higher level of uniformity and tensile strength at a particular level of drainage resistance. It would further be desirable to achieve the strength improvements without having to add expensive chemicals to the pulp. Finally, it would be desirable to accomplish the improvement in strength without any concurrent substantial increase in the fiber length.

It is therefore an object of this invention to provide a cellulose pulp offering improved strength.

It is another object of this invention to provide a cellulose pulp offering a higher paper strength at a particular level of drainage resistance as compared to conventional cellulose pulps.

It is a further object of this invention to provide a cellulose pulp offering improved paper strength at a particular level of drainage and at a particular fiber length relative to conventional cellulose pulps.

These and other objects are obtained using the present invention, as will be seen from the following disclosure.

All percentages, ratios and proportions herein are by weight, unless otherwise specified.

SUMMARY OF THE INVENTION

The present invention is a cellulose pulp offering improved paper strength potential comprised of wood fibers of selected morphology and characterized by having a normalized strength value related to the average fiber length by the equation:

$$NSV > (75 \times L) + (150 \times I),$$

where NSV is the normalized strength value (g/in/sec), L is the average fiber length (mm), and I is the dimensionless fibrillation index, with $0 \leqq I \leqq 1.0$.

More preferably, the improved cellulose pulp comprised of wood fibers has a normalized strength value that is related to the average fiber length by the equation:

$$NSV > (100 \times L) + (150 \times I).$$

DETAILED DESCRIPTION OF THE INVENTION

Figure 1:
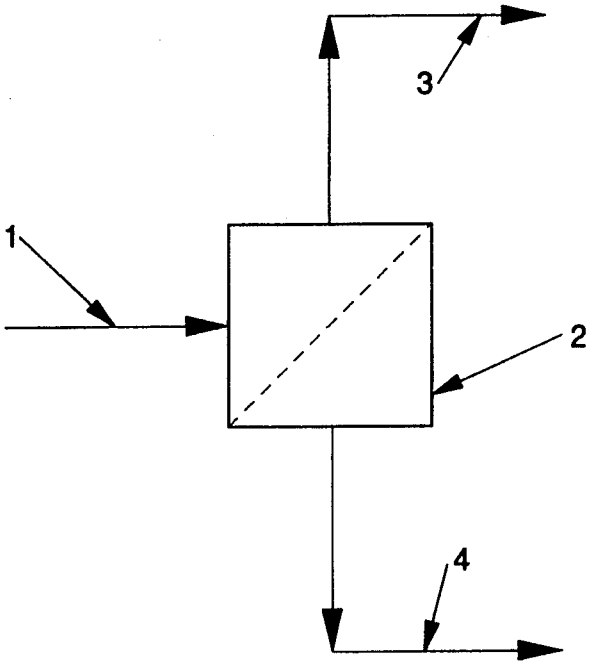
PRIOR ART Fig. 1
FIG. 1 is a flow diagram depicting a screening process in which a fibrous pulp slurry is separated into two fractions of fibers having different fiber length.

Briefly, the present invention is a cellulose pulp possessing the potential to yield improved levels of strength in paper structures at a particular rate of water drainage. These heretofore unachievable levels of strength are made possible by selecting fibers of preferred morphology from cellulose pulp sources of varying degrees of fibrillation.

As used herein, the term "morphology" refers to the various physical forms of wood fibers including such characteristics as fiber length, fiber width, cell wall thicknesses, coarseness, degree of fibrillation and similar characteristics, determined both on the basis of bulk average properties as well as on a local or distributive basis. The term "selected morphology" refers to fibers which have been selected from the general class of fibers to provide enhanced performance with regard to tensile strength and drainage rate.

As used herein, the term "fibrillation" refers to the plasticization and flexibilation of the fibers, both internally within the fiber's ultrastructure and externally on the fiber surface. The extent of fibrillation, at degrees relevant to the present invention, is indicated by either the strength potential of the cellulose fibers or the rate at which water will drain from aqueous slurries of the cellulose pulp or a combination of the strength and the drainage rate. Three regimes of fibrillation are relevant to the present invention: non-fibrillated, optimally fibrillated, and partially fibrillated.

As used herein the term "non-fibrillated" fibers refers to the condition where the fibers possess only a minimal level of fibrillation. For purposes of the present invention, fibers are classified as non-fibrillated if their rate of drainage is related to their average fiber length by the equation:

$$PFR < 5.26 - (0.55 \times L)$$

where the PFR is the pulp filtration resistance (sec) and L is the average fiber length (mm).

As used herein, the term "optimally fibrillated" refers to fibers in the condition where any additional fibrillation of the fibers is degradative to the normalized strength value (NSV). If a fiber specimen possesses a PFR in excess of that satisfying the condition of non-fibrillated; it can be further categorized by subjecting a sample of it to slight refining on a laboratory PFI mill, and comparing the NSV before and after the refining. The PFI mill is a smooth bedplate type beater; the operational method is described in Standard C. 7 of the Canadian Pulp and Paper Association. If the NSV is reduced by the additional refining, then the fiber specimen is considered to be in the condition of optimal fibrillation. If the NSV is increased by the additional refining, then the specimen is considered to be in a condition of partial fibrillation.

As used herein, the term "partial fibrillation" refers to the condition where the fibers have a level of fibrillation greater than non-fibrillated but less than optimal fibrillation. The degree of partial fibrillation is characterized by the fibrillation index, I (the method of calculating I will be discussed hereinafter).

Normalized Strength Value (NSV)

The term normalized strength value (NSV), as used herein refers to a ratio of paper strength to drainage, such that:

$$NSV = T/PFR,$$

where T is the tensile strength of lightweight handsheets (g/in) and PFR is the drainage rate (sec).

Tensile Strength (T)

The term "tensile strength", abbreviated as "T" in the algebraic equations contained herein, refers to the tensile strength of lightweight handsheets made from the cellulose pulps as described below.

The tensile strength is measured using one inch wide strips cut from lightweight handsheets. The span of the specimen between tensile clamps is 4 inches, initially, and an electronic tester (e.g., a Thwing Albert Intelect II Model 1450-24-A) is used to strain the specimen at a constant 0.5 in/min elongation rate. Specimens are conditioned to 50% relative humidity and 73° F. prior to testing, and the results are corrected for variations in basis weight to a value of 16.5 lb/3000 sq. ft. (26.9 $g/m^2$).

The handsheets upon which these tests are to be performed are specially designed to simulate lightweight, low density tissue papers. The handsheeting procedure is similar to that described in TAPPI Standard T 205 os-71, except that a lower basis weight is used. In addition, the method of transferring the web from the forming wire and the method of drying the paper are modified. The modifications from the industry standard method are described below.

The amount of pulp added is adjusted to result in a conditioned basis weight of 26.9 $g/m^2$.

The method of transferring the web is as follows: First, the web is formed on a plastic mesh cloth (84×76-M from Appleton Wire Company, or equivalent). The orientation of the cloth should be so that the sheet is formed on the side with discernible strands in one direction (the other side of the cloth is smooth in both directions). For the present work, a 12 inch by 12 inch deckle box is employed in the tests described herein (although equivalent sizes would also be acceptable). The hand sheet mold is equipped to retain the cloth during sheet forming, and then allow its release with the wet web intact on its surface. Excess water is removed by subjecting the cloth, with the wet web on its surface, to a vacuum of from 3.5 to 4.5 inches of mercury. The vacuum is applied by pulling the cloth across a vacuum slot at a rate of about 1 foot per second. The direction of travel is selected so that the forming cloth is pulled perpendicular to the direction of its discernible strands. The web, so prepared, is transferred onto a 36×30 polyester fabric cloth (e.g., a 36-C from Appleton Wire, or equivalent) by a vacuum of from 9.5 to 10.5 inches of mercury over the vacuum slot. The direction of motion of the web is the same in both vacuum steps, and the 36×30 cloth is used so that the direction having 36 strands is used as the direction of motion.

The wet web and the polyester fabric are dried together on a heated stainless steel dryer drum that is 18 inches wide and 12 inches in diameter. The drum is maintained at a surface temperature of 230° F., and rotated at a speed of from 0.85 to 0.95 revolutions per minute. The wet web and polyester fabric are inserted between the dryer surface and a felt covering the surface and mounted to travel at the same speed as the drum. A felt of ⅛" thickness, style #1044; Commonwealth Felt Company, 136 West Street Northhampton, Mass. 01060 (or equivalent) is employed. The felt is wrapped to cover 63% of the dryer circumference. The wet web is dried in this manner twice with the direction of motion from the transfer step being maintained each time. The first drying step is completed with the fabric next to the dryer surface; the second step with the web next to the surface.

Because this method of handsheeting introduces a chance for a slight anisotropy to be created, all testing is performed in both directions with the result averaged to obtain a single value.

Fibrillation Index (I)

The degree of fibrillation is characterized by the fibrillation index, I. For non-fibrillated fibers as defined above, I is equal to 0. For optimally fibrillated fibers, as defined above, I is equal to 1.0. For partially fibrillated fibers, as defined above, $0<I<1.0$. The fibrillation index is determined as follows.

$$I=[PFR-(5.26-0.55\times L)]/[PFR\text{-}@MOF-(5.26-0.55\times L)]$$

where I is the fibrillation index (dimensionless); PFR is the specimen pulp filtration resistance (sec); PFR @MOF is the PFR (sec) at the minimum optimal fibrillation; and L is the average fiber length (mm).

Minimum Optimal Fibrillation (MOF)

As used herein the term minimum optimal fibrillation refers to the condition of fibers which exist at the lowest PFR at which the criterion for the condition of optimal fibrillation is met. Partially fibrillated fibers subjected to increments of refining display the behavior of an increasing NSV; the point at which NSV fails to further increase is considered to be the point of minimum optimal fibrillation.

Pulp Filtration Resistance (PFR)

The PFR is, like the Canadian Standard Freeness (CSF), a method for measuring the drainage rate of pulp slurries. It is believed that the PFR is a superior method for characterizing fibers with respect to their drainage characteristics. For purposes of estimation, the CSF may be related to the PFR by the following formula:

$$PFR=11270/CSF-10.77,$$

where the PFR is in units of seconds and the CSF is in units of milliliters. Because this relationship is subject to error it should be used for estimation purposes only. A more accurate method of measuring the PFR is as follows.

The PFR is measured by discharging three successive aliquots of a 0.1% consistency slurry from a proportioner and filtering through a screen connected to the proportioner discharge. The time required to collect each aliquot is recorded and the screen is not removed or cleaned between filtrations.

The proportioner (obtained from Special Machinery Corporation, 546 Este Avenue, Cincinnati, OH 45232, Drawing #C-PP-318) is equipped with a PFR attachment (also obtained from Special Machinery Corporation, Drawing #4A-PP-103, part #8). The PFR attachment is loaded with a clean screen (a 1⅛" die cut circle of the same type of screen used for handsheeting, Appleton Wire 84×76M, is used and it is loaded with the sheet side "up" in the tester).

A 0.10% consistency slurry of disintegrated pulp is prepared in the proportioner at a volume of 19 liters, with the PFR attachment in position. A 100 ml volumetric flask is positioned under the outlet of the PFR attachment. The proportioner outlet valve is opened and a timer started, the valve is closed and timer stopped the instant 100 ml is collected in the volumetric flask (additional liquid will probably drain into the flask after the valve is closed). The time is recorded to the nearest 0.10 seconds, noted as "A".

The filtrate is discarded, the flask repositioned, and another 100 ml aliquot is collected by the same procedure without removing or cleaning the screen between filtrations. This time interval is recorded as "B".

Again, the filtrate is discarded, the flask repositioned, and another 100 ml aliquot is collected by the same procedure without removing or cleaning the screen between filtrations. This time interval is recorded as "C".

PFR is then calculated using the following equation:

$$PFR=\sqrt{\frac{(E)\times(B+C-(2\times A))}{1.5}}$$

where A, B, and C are the recorded time intervals, and E is a function of temperature used to correct the PFR to the value that would be observed at 75 degrees F.:

$$E=1+(0.013\times(T-75)),$$

where T is the slurry temperature measured to the nearest degree F in the proportioner after taking the last aliquot.

Average Fiber Length (L)

As used herein the term "average fiber length", abbreviated "L" in the algebraic equations contained herein, refers to the weighted average fiber length measured and computed with an optical-based analyzer manufactured by Kajaani (model FS-100 equipped with a 0.4 mm capillary). The Kajaani analyzer computes and displays two average fiber lengths. The "arithmetic average fiber length" is calculated according to the formula, $\Sigma n_i \mathbf{l}_i/\Sigma n_i$, where $n_i$ is the number of fibers in class i and $\mathbf{l}_i$ is the mean length of fibers in class i. This average is not generally accepted by industry as an accurate measure of fiber length. It overemphasizes the contribution of short fibers. The other average fiber length is referred to as the "weighted average fiber length". This average is the most commonly used measure of fiber length in industry. It is calculated by the Kajaani instrument using the formula, $\Sigma n_i l_i^2/\Sigma n_i l_i$. This weighted length is used in formulas contained in this specification, wherever a fiber length, L, is specified.

Essentially, the present invention is a cellulose pulp offering improved paper strength potential comprised of wood fibers of selected morphology and characterized by having a normalized strength value related to fiber length by the equation:

$$NSV > (75 \times L) + (150 \times I),$$

where NSV is the normalized strength value (g/in/sec), L is the average fiber length (mm), and I is the dimensionless fibrillation index.

More preferably, the improved cellulose pulp is comprised of wood fibers having a normalized strength value that is related to the average fiber length by the equation:

$$NSV > (100 \times L) + (150 \times I).$$

Most preferably, the improved cellulose pulp is comprised of wood fibers having a normalized strength value that is related to the average fiber length by the equation:

$$NSV > (125 \times L) + (150 \times I).$$

Fiber length is an important variable in papermaking. If fibers are too short the paper may not be satisfactory with respect to energy absorption properties such as tearing or bursting strength or tensile elongation. If the fibers are too long, they tend to form flocks which can cloud formation in the paper and degrade important properties such as tensile strength.

A preferred weighted average fiber length range for partially and optimally fibrillated cellulose pulps according to the present invention is in the range of from about 1.0 to about 2.2 mm. More preferably, the average fiber length is from about 1.3 to about 2.0 mm.

For cellulose pulps classified as non-fibrillated (I=0), the preferred average fiber length range for use in the present invention is from about 1.0 to about 3.5 mm.

Although the NSV is the key parameter in characterizing the strength potential of fibers according to the present invention, the tensile strength potential is also an important parameter. The term "tensile strength potential" as used herein, refers to the tensile strength of lightweight handsheets made from the wood fibers according to the previously described procedure. Excessive tensile strength can sometimes result in harshness of the paper for applications such as tissue paper, whereas, insufficient strength cannot always be mitigated by refining.

Preferably, the tensile strength potential of cellulose pulps of the present invention classified as partially fibrillated is from about 1200 g/in to about 4000 g/in. More preferably, the tensile strength potential is from about 1200 to about 2500 g/in, and, most preferably, the tensile strength potential is from about 1600 to about 2250 g/in.

For cellulose pulps of the present invention classified as optimally fibrillated (i.e. I=1.0), the tensile strength potential is somewhat higher. A preferred tensile strength potential is 1500 g/in to about 5000 g/in. More preferably the tensile strength potential is from about 1500 to about 3500 g/in, and, most preferably, the tensile strength potential is from about 2000 to about 3250 g/in.

For cellulose pulps of the present invention classified as non-fibrillated (i.e., I=0), the tensile strength potential is somewhat lower. Preferably, tensile strength potential is maintained in the range of from about 500 g/in to about 2000 g/in, and more preferably, the tensile strength potential is maintained in the range of from about 750 g/in to about 1500 g/in.

The term cellulose pulp, as used herein, refers to fibrous material derived from wood for use in making paper or other types of cellulosic products. Cellulose wood fibers from a variety of sources may be employed to produce cellulose pulps which comply to the specification of the present invention. These include chemical pulps, which are pulps purified to remove substantially all of the lignin originating from the wood substance. These chemical pulps include those made by either the sulfite, or Kraft (sulfate) processes. Applicable wood fibers may also be derived from mechanical pulps such as groundwood pulps, thermomechanical pulps, and chemithermomechanical pulps, all of which retain a substantial amount of the lignin originating from the wood substance. Both hardwood pulps and softwood pulps as well as blends of the two may be employed. The term hardwood pulp as used herein refers to a fibrous pulp derived from the woody substance of deciduous trees; wherein softwood pulps are fibrous pulps derived from the woody substance of coniferous trees. Also applicable to the present invention are fibers derived from recycled paper, which may contain any or all of the above categories as well as other non-fibrous materials such as fillers and adhesives used to facilitate the original papermaking.

The term recycled paper generally refers to paper which has been collected with the intent of liberating its fibers and reusing them. These can be pre-consumer paper such as that originating from paper mill or print shop waste, or post-consumer paper such as that originating from home or office collection. Recycled papers are sorted into different grades by dealers to facilitate their re-use. One grade of particular value in the present invention is ledger paper, either white or colored. Ledger papers are usually comprised of chemical pulps and typically have a hardwood to softwood ratio of from about 1:1 to 2:1. Examples of ledger papers include bond, book, xerographic paper and the like. Another grade of recycled paper useful in the present invention is old newspapers. Old newspapers are typically comprised of nearly all softwood fibers with generally greater than 70% being mechanical pulp.

Figure 2:
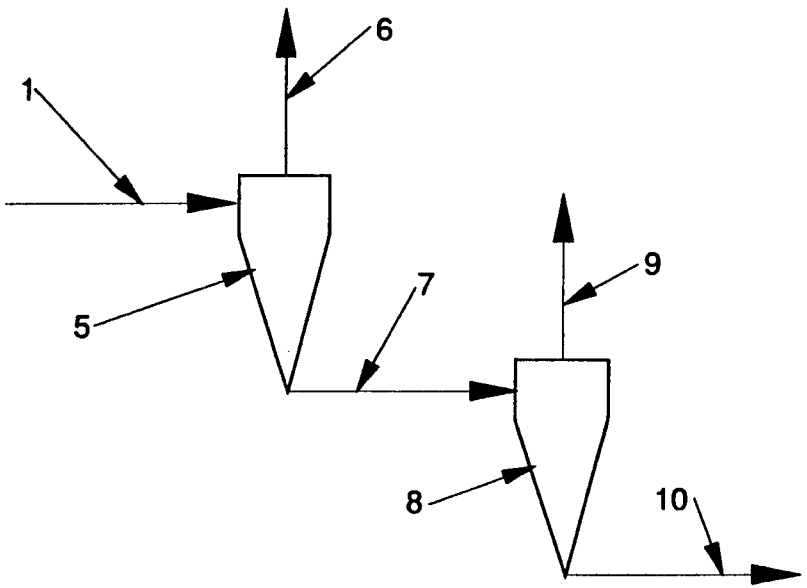
PRIOR ART Fig. 2
FIG. 2 is a fiber fractionation flow diagram depicting a process for separating fibers into fractions with different specific surface using hydraulic cyclones.
Figure 3:
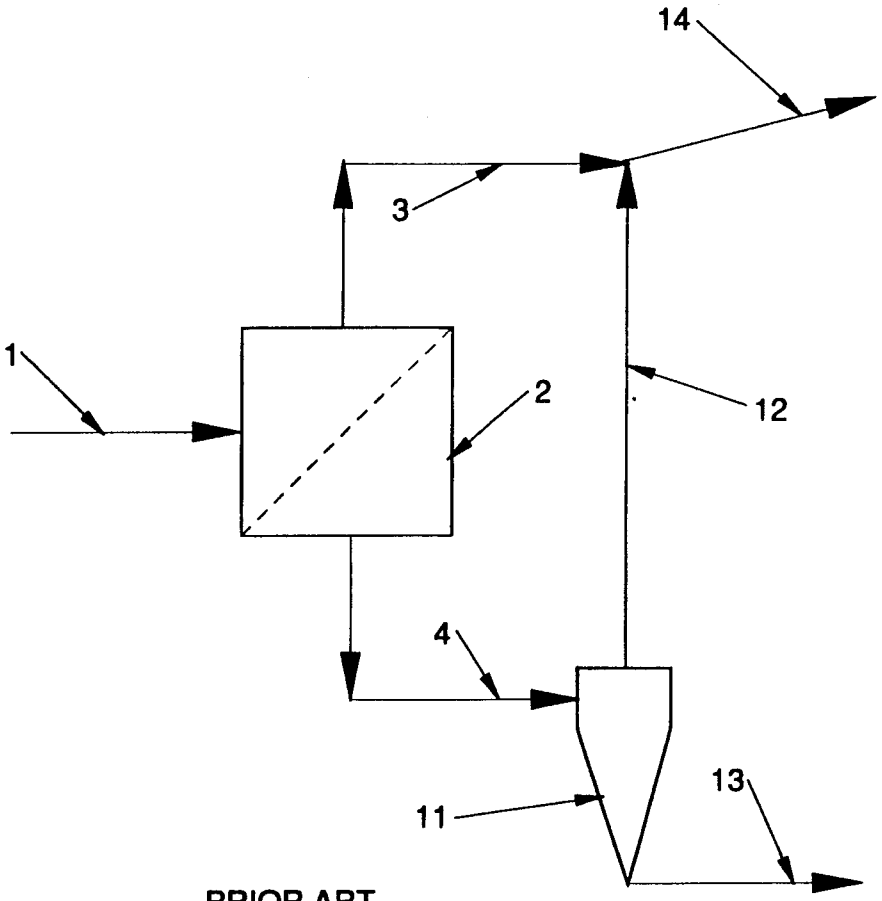
PRIOR ART Fig. 3
FIG. 3 is a fiber fractionation flow diagram incorporating both a screen and a hydraulic cyclone.

FIGS. 1-3 illustrate fiber fractionation methods disclosed by the prior art. Unfortunately, the prior art methods of fractionating are not effective at yielding fibers which can be aggregated into the specific cellulose pulps of the present invention.

FIG. 1 is a flow diagram of a screening process in which a fibrous pulp slurry is separated by a screen 2 into two fractions of fibers having different fiber length. Slurry 3 contains fibers having an average fiber length exceeding those of slurry 1, while slurry 4 contains fibers having an average fiber length less than those of slurry 1. Several prior art references exist for screening fiber-containing slurries. See, for example, U.S. Pat. No. 4,938,843, Lindhal, issued Jul. 3, 1990, incorporated herein by reference, which illustrates how a screen may be used in the fashion depicted in FIG. 1.

FIG. 2 is a fiber fractionation flow diagram of a process for separating fibers utilizing hydraulic cyclones. The arrangement in FIG. 2 is based on the arrangement disclosed in U.S. Pat. No. 3,301,745, Coppick et al, issued Apr. 26, 1963, incorporated herein by reference. A fibrous pulp slurry 1 is charged to a cyclone 5 and separated into a slurry 6 which contains fibers of higher specific surface than the fibers of slurry 1 and into a slurry 7 which contains fibers of lower specific surface than the fibers of slurry 1. Part of slurry 7 can be recovered by charging it to a secondary cyclone 8 and separating it into high specific surface fraction slurry 9 and a low specific surface fraction slurry 10 and then mixing slurry 9 with slurry 6.

FIG. 3 is a fiber fractionation flow diagram incorporating both a screen and a hydraulic cyclone. An example of such an arrangement is disclosed in U.S. Pat. No. 4,938,843 mentioned above. A fibrous pulp slurry 1 is first introduced to a screen 2 and separated into a long fiber slurry 3 and a short fiber slurry 4. The short fiber slurry 4 is then introduced to a hydraulic cyclone 11 where it is separated into slurry 12 containing fibers of higher specific surface than those of slurry 4 and slurry 13 containing fibers of lower specific surface than those of slurry 4. The fibers of slurry 3 and slurry 12 are then combined to form slurry 14 whose fibers are a mixture of relatively long and relatively high specific surface fibers.

While not intended to be construed as limiting the present invention to a certain set of process steps, the following illustrates several methods of preparing cellulose pulps which comply to the specifications of the present invention. These include methods of fractionating fibers by a combination of size and shape. Also included are certain methods employing a mechanical pre-treatment step, before fractionating the fibers according to size and shape.

Figure 5:
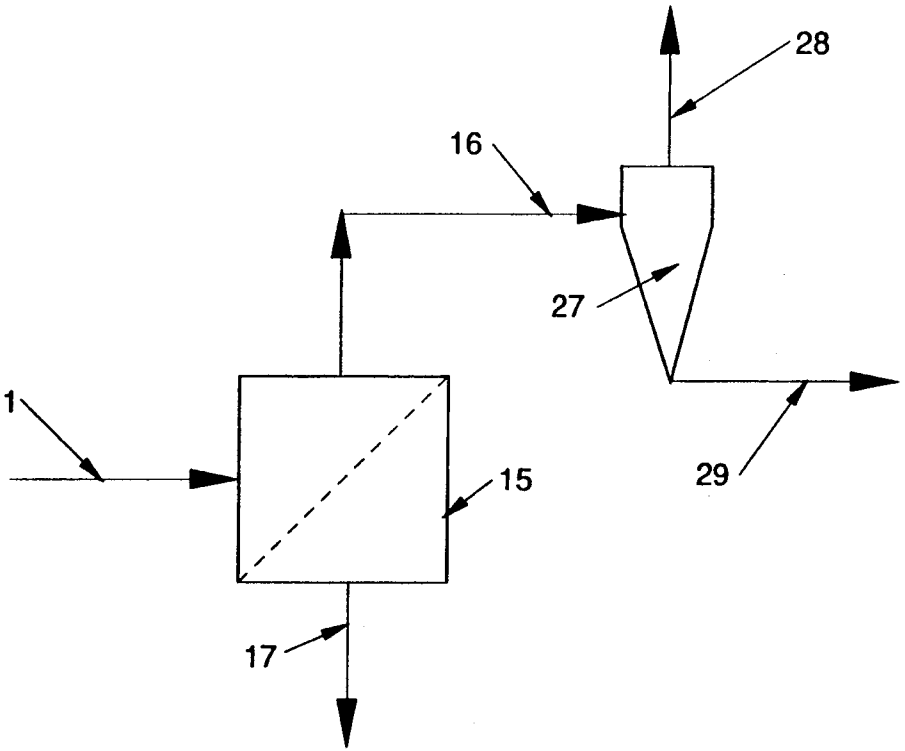
FIG. 5 is a fiber fractionation flow diagram illustrating an alternate process arrangement capable of yielding cellulose pulps in accordance with the present invention.
Figure 6:
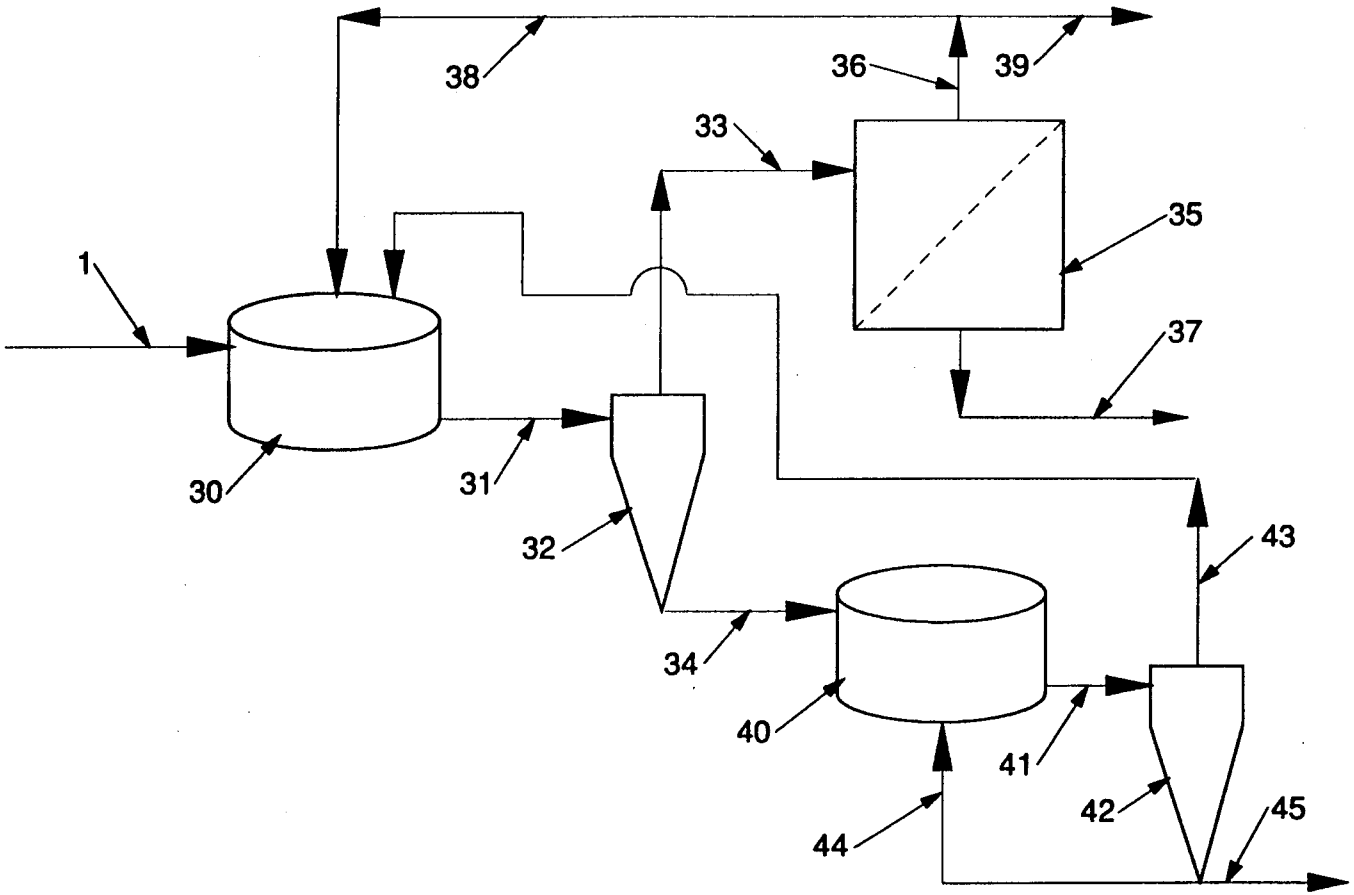
FIG. 6 is a fiber fractionation flow diagram illustrating an alternate process arrangement capable of yielding cellulose pulps in accordance with the present invention.
Figure 7:
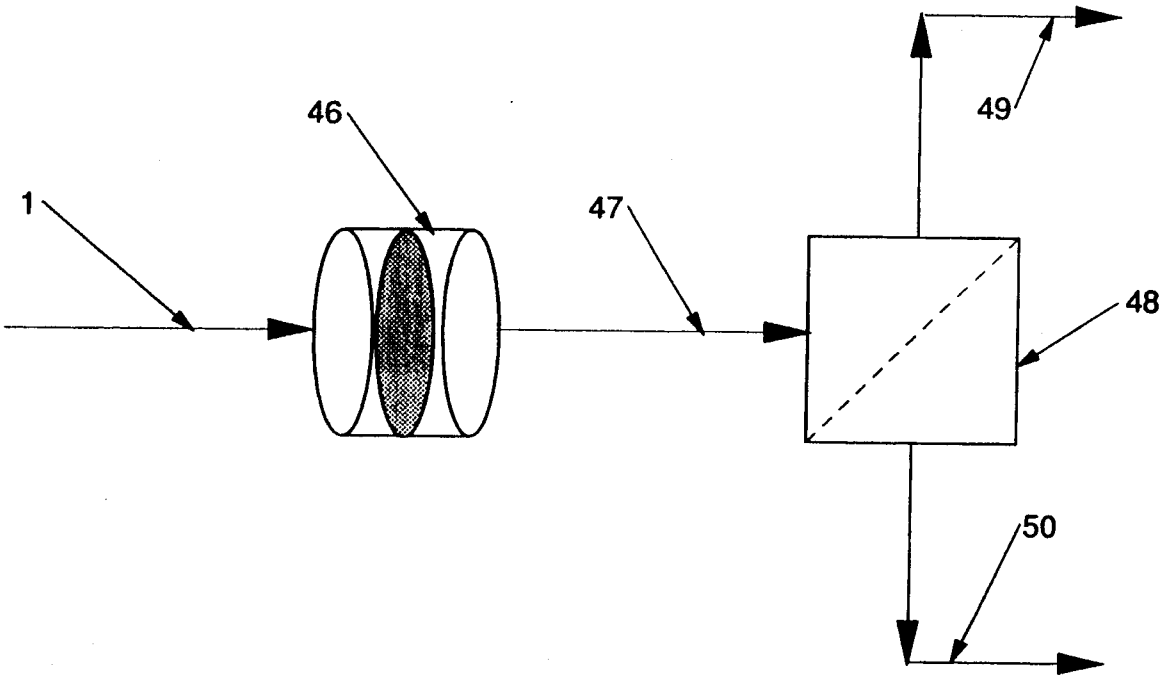
FIG. 7 is a flow diagram illustrating another process method capable of yielding cellulose pulps in accordance with the present invention.

FIGS. 4–7 illustrate various arrangements of process steps, all of which under certain conditions can be used to produce the cellulose pulps of present invention. The methods illustrated in the equipment arrangements of FIGS. 4–6 can be distinguished from the prior art in that they disclose fractionation sequences which have both fines removal steps and steps for fractionation by fiber specific surface. FIG. 7 illustrates yet another process sequence which involves imparting mechanical energy to the fibers prior to their fractionation. With proper selection of the raw cellulose fiber and the method of applying mechanical energy, it may be possible to eliminate the cyclone steps of FIGS. 4-6, simplifying the process to that detailed in FIG. 7 while continuing to meet the strength levels specified in the present invention.

A more detailed description of the methods depicted in FIGS. 4–7 follows.

Figure 4:
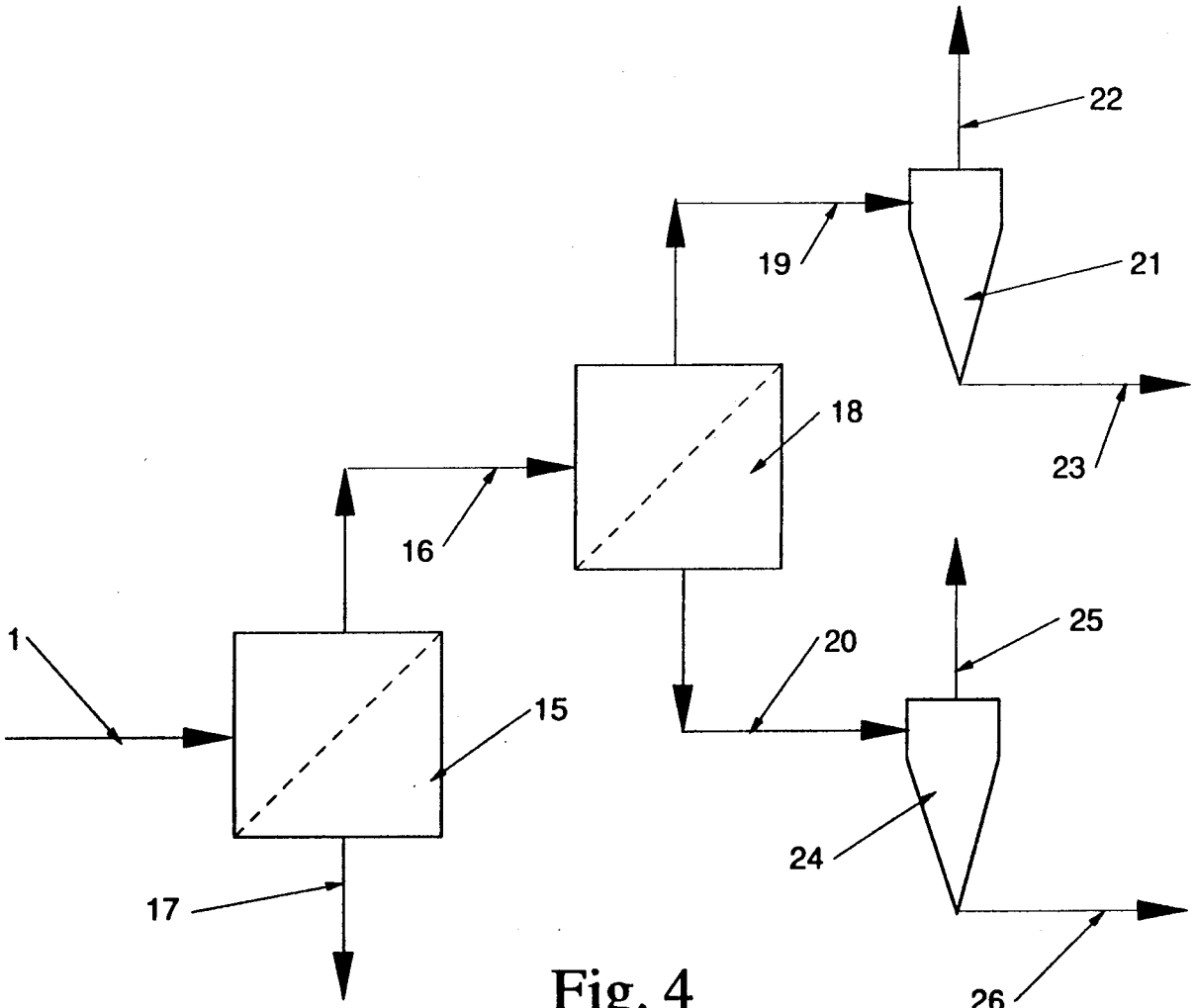
FIG. 4 is a fiber fractionation flow diagram illustrating one process arrangement which can be used to prepare cellulose pulps in accordance with the present invention.

FIG. 4 is a fiber fractionation flow diagram illustrating one process arrangement which can be used to prepare cellulose pulps in accordance with the present invention. A fibrous pulp slurry 1 is first passed to a screen 15, and separated into a slurry 16 containing a fiber fraction and a slurry 17 containing a fines fraction. Slurry 16 containing the fiber fraction is then passed to a screen 18 which acts to create a slurry 19 containing a long fiber fraction and a slurry 20 containing a short fiber fraction. Slurry 19 containing the long fiber fraction is next charged to a cyclone 21 which further separates it into slurry 22 containing fibers of relatively high specific surface and slurry 23 containing fibers of relatively low specific surface. Optionally, another cyclone stage represented by cyclone 24 can be used to create a relatively high specific surface fraction 25 and a relatively low specific surface fraction 26 from slurry 20. Slurry 22 contains fibers of the characteristics that in aggregate meet the criteria of the cellulose pulps described in the present invention. Slurries 23 and 25 can be recirculated to any point upstream of the cyclone stages to recover their fiber into one of the three output slurry streams 17, 22, and 26.

FIG. 5 is a fiber fractionation flow diagram illustrating another process arrangement capable of yielding cellulose pulps which meet the criteria of the present invention. A fibrous pulp slurry 1 is first passed to a screen 15, and separated into a slurry 16 containing a fiber fraction and slurry 17 containing a fines fraction. Slurry 16 containing the fiber fraction is then charged to a cyclone 27 which acts to create a slurry 28 containing a high specific surface fraction and a slurry 29 containing a low specific surface fraction. Slurry 28 contains fibers which, in aggregate, meet the criteria of the cellulose pulps of the present invention.

FIG. 6 is a fiber fractionation flow diagram illustrating another process arrangement capable of yielding cellulose pulps which meet the criteria of the present invention. A fibrous pulp slurry 1 is first passed to a container 30 until filled. The contents of container 30 are then passed through line 31 to hydraulic cyclone 32, and separated into a slurry 33 containing a high specific surface fraction and slurry 34 containing a low specific surface fraction. Slurry 33 is passed to a screen 35 which acts to create a fiber fraction contained in slurry 36 and a fines fraction contained in slurry 37. The fiber fraction 36 is recirculated through line 38 to container 30. This process is continued until the fibers of slurry 36 meet the desired strength characteristics at which time slurry 36 is diverted to an outlet through line 39 rather than being recirculated to container 30. The characteristics of the fibers in slurry 36 passing through line 39 are such that in aggregate they meet the criteria of the present invention. Meanwhile, the reject slurry 34 from cyclone 32 is collected in container 40. After completion of the batch process yielding final slurry 36, the contents of container 40 are passed to hydraulic cyclone 42 which acts to create a high specific surface fraction contained in slurry 43 and a low specific surface fraction contained in slurry 44. Slurry 44 is recirculated to container 40. This process is continued until the strength potential of fibers in slurry 44 decrease to a certain threshold level at which time they are diverted to an outlet through line 45 rather than being returned to container 40. The rejected fibers contained in slurry 43 are returned to container 30. After completing the batch process which culminates with the production of outlet slurry 44 through line 45, container 30 is replenished with additional fibrous pulp slurry 1 until filled and the batch processes are repeated.

FIG. 7 is a schematic diagram representing another process capable of yielding cellulose pulps in accordance with the present invention. Fibrous pulp slurry 1 is first passed to a device 46 which acts to impart mechanical energy to the fibers in slurry 1. Modified slurry 47 is then passed to a screen 48 which separates it into a slurry 49 containing long fibers and a slurry 50 containing short fibers. The fibers of slurry 49 have characteristics which in aggregate meet the criteria of the cellulose pulps of the present invention.

Device 46, used in FIG. 7 for mechanical pre-treatment of the fibers, may be one or more of several devices classified in the art as refiners or mixers. Examples of such devices include rotary beaters, double disc refiners, conical refiners, pulpers and high consistency mixers such as the Frotapulper manufactured by Kamyr of Glens Falls, N.Y. These devices introduce fibrillation and/or curl to fibers to alter their drainage characteristics.

Figure 8:
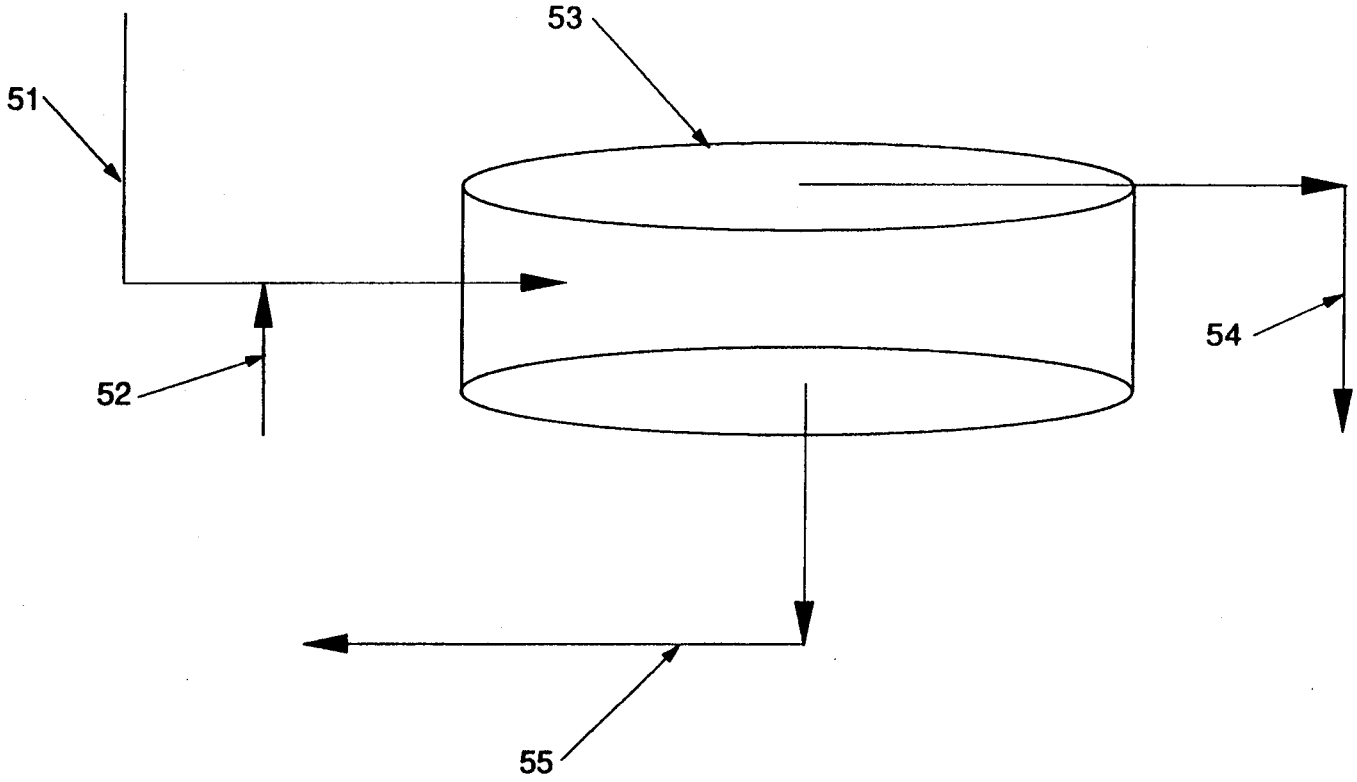
FIG. 8 is a schematic representation of a water clarifier used to remove the solids from slurries containing fines fractions.

The operation procedure for the screens and cyclones of FIGS. 4–7 are essentially the same as described in the prior art. As such, quantities of water are required for forming the slurries at each stage of the process. Since water reuse would normally be desired in any of the process methods illustrated in FIGS. 4–7, a method of recovering the fines to yield usable water without reintroducing the fines to the process is needed. The slurries containing the fines fraction are exemplified by slurry 17 of FIG. 4, slurry 17 of FIG. 5, slurry 37 of FIG. 6, and slurry 50 of FIG. 7. FIG. 8 illustrates a water clarification step that may be used in combination with the above-described methods of yielding cellulose pulps which meet the criteria of the present invention. The water clarifier of FIG. 8 may be one of the many types mentioned in the literature. An acceptable clarifier works on the principal of injecting air to create air bubbles which attach to solid particles and cause them to rise to the surface where they may be collected. This leaves substantially solids-free water which can be reused to create slurries without reintroducing the fine material to the fractionation processes illustrated in FIGS. 4–7. In FIG. 8, slurry 51, which is a fines-containing slurry, is mixed with air introduced through line 52. This mixture is introduced to a quiescent holding vessel 53 where the solids are allowed to float to the surface where they are skimmed from the surface in the form of thickened slurry 54, releasing substantially solids-free water through line 55.

While not wishing to be bound by theory or to otherwise limit the present invention, the following explanation is offered for the unexpected results achieved via the practice of the foregoing methods to create cellulose pulps which meet the criteria of the present invention. Fine fibrillar and non-fibrillar fragments have a relatively large effect on limiting the drainage of cellulose pulps without offering a concomitant improvement in paper strength. Converse to this, relatively high specific surface fibers tend to offer improved strength with a less than concomitant denigration in drainage. By selecting morphologic forms of wood fibers high in specific surface fibers but excluding the high specific surface fibers of short fiber length, new levels of strength as a function of drainage can be achieved. Alternatively, with sufficient fibrillation, the exclusion of high specific surface fibers of short fiber length may alone be a sufficient condition to reach these new strength levels.

The cellulose pulps of the present invention are suitable for use in a wide variety of papers and papermaking processes. The cellulose pulps are particularly suitable for use in making papers having densities of $<0.15$ g/cc. Papers having such low density (i.e., $<0.15$ g/cc) and low basis weight (i.e, $<30$ g/m$^2$) are especially suitable for use as tissue paper and paper towels. [The density values stated herein are determined by measuring the apparent thickness using a 2 square inch plate exerting a force of 32.5 grams per square inch. A stack of five plies of paper are measured and the result divided by five to determine the thickness of a single ply. The density is then calculated from the apparent thickness and the basis weight.]Such papers have relatively low capacity to retain fines resulting in high solids concentration in the papermachine water system. In addition, it is difficult to achieve requisite strength in such papers because of the low fiber to fiber contact area resulting from the low density.

The present invention overcomes both of the above limitations. Since pulps of the present invention are largely free of fines, their retention is not a problem. In addition, the pulps of the present invention offer improved strength, thereby mitigating the adverse effects resulting from the low fiber to fiber contact area in the low density papers.

The following examples illustrate the practice of the present invention but are not intended to be limiting thereof.

EXAMPLE 1

This example illustrates a method of making improved cellulose pulps which meet the criteria of the present invention by a process consisting essentially of fines removal and hydraulic cyclones. The process used to make the cellulose pulps in this example is illustrated in FIG. 6.

The following is a more detailed description of the process depicted in FIG. 6:

1. Containers 30 and 40 each have a capacity of 1000 gallons.
2. Slurry 1 contains fibers obtained from Ponderosa Fibres from their Oshkosh mill. The pulp, as obtained, is in wet lap form at a consistency of approximately 50% solids. The pulp is a cleaned wastepaper furnish comprised of ledger paper.
3. Cyclone stations 32 and 42 contain 10 cyclones of 3" diameter, in parallel, obtained from CE Bauer Company. The cyclones are operated at 75 psi inlet pressure and 10 psi backpressure on the overflow side. The underflow is discharged to atmosphere through a 3/16 inch lower section.
4. Screen 35 is a CE Bauer Micrasieve. The Micrasieve is a 24" unit and is equipped with a 100 micron slotted screen.
5. When operating to produce slurry 33, water is added at the cyclone inlets to maintain consistency at the beginning of a batch operation at approximately 1.2%. The total batch time is 44 minutes, and the consistency drops continuously over the course of the operation; at the end of the cycle time the consistency entering cyclone station 32 is about 0.5%. A pulp charge of about 250 lbs. of pulp in container 30 is reduced to a batch size of about 16 lbs. exiting through line 39.
6. When operating to produce slurry 44, water is added at the cyclone inlets to maintain consistency at the beginning of a batch operation at approximately 1.2%. The total batch time is 26 minutes, and the consistency is continuously lowered over the course of the operation; at the end of the cycle time the consistency feeding cyclone 42 is at about 0.25%. A pulp charge of about 250 lbs. of pulp in container 40 is reduced to a batch size of about 8 lbs. exiting through line 45.
7. The sequence of FIG. 6 is modified in this example, to produce three batches of slurry 44 exiting through line 45 prior to continuing to produce a batch of slurry 36. This is equivalent to returning the contents of container 40 to container 30 after the first and second batches of slurry 44 are produced in each period.

The performance data on the cellulose pulp obtained by the above-described process are the cumulative results of blends of 150 batches of slurry 36 exiting through line 39. The resultant cellulose pulp performed in the following manner.

The tensile strength of lightweight handsheets made from the cellulose pulp in accordance with the previously described procedure, is 1871 g/in. The PFR of the cellulose pulp is 6.5 sec. The resultant NSV is calculated to be 257 g/in/sec. The weighted average Kajaani fiber length is 1.71 mm.

The maximum PFR for non-fibrillated fibers of this length is calculated to be $5.26-(0.55\times1.71)$, which is equal to 4.3. Since the observed PFR is higher than this value, the cellulose pulp is deemed to be either partially or optimally fibrillated.

The specimen is refined over the interval of 500–4000 revolutions on the PFI mill and an initial increase in the NSV is observed followed by a decline. This allows categorization of the cellulose pulp as partially fibrillated. Further, the maximum NSV achieved by refining on the PFI mill is achieved at a PFR of 8.6 sec. This allows calculation of the fibrillation index, I as follows.

$$I=(6.5-4.3)/(8.6-4.3)$$

$$I=0.51$$

The threshold NSV meeting the requirements of this specification is calculated as follows.

$$\text{Threshold NSV}>(75\times L)+(150\times I);$$

$$\text{Threshold NSV}>(75\times1.71)+(150\times0.51)$$

$$\text{Threshold NSV}>206$$

Since the observed NSV of 257 g/in/sec exceeds the threshold NSV of 205 g/in/sec, the cellulose pulp prepared in this example meets the requirements of the present invention.

Handsheets prepared according to the procedure specified herein are measured to have a density of 0.11 g/cc.

In addition, the cellulose pulp prepared according to this example is made into disposable paper towels by preparing first a single ply of paper on a papermachine which is then converted into a two-ply toweling by lamination. The cellulose pulp displayed excellent processability and delivered excellent strength in the toweling.

EXAMPLE 2

This example illustrates improved cellulose pulps which meet the criteria of the present invention made by a process consisting essentially of mechanical pretreatment followed by screening. The process used to make the cellulose pulps in this example is illustrated in FIG. 7.

The following is a more detailed description of the process depicted in FIG. 7:

1. Slurry 1 is formed from fibers of Northern Softwood Kraft Pulp obtained from the Grande Prairie mill of the Procter & Gamble Company.
2. Device 46 is a Noble and Wood laboratory beater, model no. SO-81236. The Noble and Wood beater is operated on a batch size of 3.5 lbs of pulp on a bone dry basis. This pulp is slurried in 14 gallons of water and added to the beater. The load is engaged and the specimen is beaten for a batch time of 30 minutes.
3. Slurry 47 is introduced to screen 48 (a 30 inch SWECO screen). As a 3.5 lb (bone dry basis) charge of fibers from slurry 47 is introduced to screen 48, water is continuously introduced to the top of the SWECO to keep the slurry fluidized. The SWECO is equipped with a 60 mesh screen. It is operated for a period of 4 hours. The fiber is removed from the top of the screen as slurry 49 (FIG. 7). The remaining fines stream (slurry 50) is washed through the screen and discarded.

The fibers of slurry 49 are tested with the following results.

The tensile strength of lightweight handsheets made from the cellulose pulp obtained from slurry 49 is measured to be 3244 g/in. The PFR is measured to be 10 sec; the calculated NSV is 324 g/in/sec. The weighted average Kajaani fiber length is 1.97 mm.

The maximum PFR for non-fibrillated fibers of this length is calculated to be $(5.56-(0.55\times1.97))$ which equals 4.18. Since the observed PFR exceeds this value, the cellulose pulp is deemed to be either partially or optimally fibrillated.

The specimen is refined on a laboratory PFI mill over the range of 500–1000 revolutions. The NSV is found to decline immediately with any additional level of refining. Therefore, the cellulose pulp is categorized as optimally fibrillated, with $I=1.0$.

The threshold NSV meeting the criteria of this invention is calculated as follows:

$$\text{Threshold NSV}>(75\times L)+(150\times I),$$

$$\text{Threshold NSV}>(75\times1.97)+(150\times1.0)$$

$$\text{Threshold NSV}>298$$

Since the observed NSV (i.e, 324) exceeds this threshold value, the cellulose pulp prepared according to this example meets the criteria of the present invention.

EXAMPLE 3

This example illustrates improved cellulose pulps which meet the criteria of the present invention made by a process consisting essentially of fines removal and hydraulic cyclones, with the fiber controlled to be in an essentially non-fibrillated condition. The process used to make the cellulose pulps in this example is illustrated in FIG. 5.

The following is a more detailed description of the process depicted in FIG. 5:

1. Slurry 1 is formed from fibers of Northern Softwood Kraft Pulp obtained from the Grande Prairie mill of the Procter and Gamble Company.
2. Slurry 1 is introduced to screen 15 (a 30 inch SWECO screen). As a 1.43 lb (bone dry basis) charge of fibers from slurry 1 is introduced to screen 15, water is continuously introduced to the top of the SWECO to keep the slurry fluidized. The SWECO is equipped with a 60 mesh screen. It is operated for a period of 4 hours. The fiber is removed from the top of the screen as slurry 16. The remaining fines stream (slurry 17) is washed through the screen and discarded.

3. Slurry 16 is then passed to cyclone 27 (a 0.5" cyclone, model PC 051319 manufactured by Krebs Engineering Company). Cyclone 27 is operated at a total flow rate of 6 liters per minute, with the inlet consistency maintained at approximately 0.2%. Slurry 28 is adjusted in consistency and re-passed through cyclone 27 for two additional passes. The three reject batches comprising slurry 29 are combined and discarded.

From the foregoing specification, one skilled in the art can easily ascertain the essential characteristics of this invention, and without departing from the spirit and scope thereof, may make various changes and modifications to adapt the invention to various usages and conditions not specifically mentioned herein. The scope of this invention shall be defined by the claims which follow.

What is claimed is:

1. A cellulose pulp having improved paper strength potential, said cellulose pulp comprising wood fibers having an observed normalized strength value that is related to a threshold normalized strength value and average fiber length by the equation:

$$NSV > (75 \times L) + (150 \times I),$$

wherein NSV is the observed normalized strength value (g/in/sec), of the fibers, L is the average fiber length (mm), and I is the dimensionless fibrillation index wherein $O < I < 1$ and L is from about 1.0 mm to about 3.5 mm.

2. The cellulose pulp of claim 1 wherein said wood fibers have an average fiber length of from about 1.0 mm to about 2.2 mm.

3. The cellulose pulp of claim 2 wherein said wood fibers have an average fiber length of from about 1.3 mm to about 2.0 mm.

4. The cellulose pulp of claim 3 wherein said wood fibers have a tensile strength potential of from about 1200 g/in to about 2500 g/in.

5. The cellulose pulp of claim 4 wherein said wood fibers have a tensile strength potential of from about 1600 g/in to about 2250 g/in.

6. The cellulose pulp of claim 4 wherein said wood fibers are comprised of recycled paper fibers.

7. The cellulose pulp of claim 6 wherein said recycled paper fibers are comprised of recycled ledger paper fibers.

8. The cellulose pulp of claim 6 wherein said recycled paper fibers are comprised of recycled newspaper fibers.

9. The cellulose pulp of claim 3 wherein $I=1$ and wherein said wood fibers have a tensile strength of from about 1500 g/in to about 3500 g/in.

10. The cellulose pulp of claim 9 wherein said wood fibers have a tensile strength potential of from about 2000 g/in to about 3250 g/in.

11. The cellulose pulp of claim 9 wherein said wood fibers are comprised of recycled paper fibers.

12. The cellulose pulp of claim 11 wherein said recycled paper fibers are comprised of recycled ledger paper fibers.

13. The cellulose pulp of claim 11 wherein said recycled paper fibers are comprised of recycled newspaper fibers.

14. The cellulose pulp of claim 1 wherein $I=0$ and wherein said wood fibers have an average fiber length of from about 1.0 mm to about 3.5 mm and a tensile strength potential from about 500 g/in to about 2000 g/in.

15. The cellulose pulp of claim 14 wherein said wood fibers have a tensile strength potential of from about 750 g/in to about 1500 g/in.

16. Paper made from the cellulose pulp of claim 1.

17. The paper of claim 16, said paper having a density of less than about 0.15 grams per cubic centimeter.

18. Paper made from the cellulose pulp of claim 6.

19. The paper of claim 6, said paper having a density of less than about 0.15 grams per cubic centimeter.

20. Paper made from the cellulose pulp of claim 9.

21. Paper made from the cellulose pulp of claim 11.

22. The paper of claim 21, said paper having a density of less than about 0.15 grams per cubic centimeter.

* * * * *

UNITED STATES PATENT AND TRADEMARK OFFICE

CERTIFICATE OF CORRECTION

PATENT NO. : 5,228,954

DATED : JULY 20, 1993

INVENTOR(S) : KENNETH D. VINSON, JOHN P. ERSPAMER

It is certified that error appears in the above-identified patent and that said Letters Patent is hereby corrected as shown below:

Column 7, line 2 after "weighted" insert therefor --average fiber--.

Column 13, line 38 delete "206" and insert therefor --205--.

Column 14, line 24 delete "5.56" and insert therefor --5.26--.

Signed and Sealed this

Twenty-second Day of November, 1994

*Attest:*

Bruce Lehman

BRUCE LEHMAN

*Attesting Officer*

*Commissioner of Patents and Trademarks*